United States Patent [19]

Mayes

[11] 4,287,875

[45] Sep. 8, 1981

[54] DAMPER SYSTEM

[76] Inventor: Clell C. Mayes, Box 8, Pigeon Forge, Tenn. 37862

[21] Appl. No.: 96,983

[22] Filed: Nov. 23, 1979

[51] Int. Cl.[3] ..... F23L 3/00

[52] U.S. Cl. ..... 126/288

[58] Field of Search ..... 126/286, 288, 295, 293, 126/285 R, 120, 121

[56] References Cited

U.S. PATENT DOCUMENTS

| | | | |
|---|---|---|---|
| 1,049,566 | 1/1913 | Delsing | 126/288 |
| 1,163,929 | 12/1915 | Jensen | 126/288 |
| 1,413,472 | 4/1922 | Goodwin | 126/288 |
| 1,928,165 | 9/1933 | Boldt | 126/288 |

FOREIGN PATENT DOCUMENTS

| | | | |
|---|---|---|---|
| 128100 | 6/1919 | United Kingdom | 126/288 |

*Primary Examiner*—James C. Yeung

*Attorney, Agent, or Firm*—Luedeka & Fitch

[57] ABSTRACT

A damper system is provided for a fireplace which communicates with a room through a front opening and which includes an upper opening and a sleeve extending from the front opening to the upper opening to direct fluid flow to the upper opening. The damper system includes plate means pivotally mounted within the sleeve. Elongated flexible means is connected to the plate means and extends to a location within the room and spaced from the front opening. The plate means is selectively pivotable by an operator without penetrating the front opening.

3 Claims, 7 Drawing Figures

DAMPER SYSTEM

The present invention relates to fireplaces of the type used primarily in residences and more particularly to an improved damper system for controlling fluid flow through the chimney of such fireplace.

Fireplaces for burning wood, gas or coal, as are generally found in residences, include a vent pipe or chimney for exhausting combustion gases to the atmosphere. Such vent pipes and chimneys extend upwardly from an opening in the uppermost portion of the fireplace to an exhaust opening on the exterior of the building. A damper for controlling the flow of fluids, primarily gases, is usually provided at about the junction of the vent pipe and the fireplace. Such dampers generally comprise one or more plate members which are pivotally mounted such that an operator can selectively pivot the plate members between an open position and a closed position. The damper is placed in the open position when a fire is burning within the fireplace in order to permit the smoke and hot combustion gases to escape through the chimney to the atmosphere. When a fire is not burning in the fireplace, the damper is placed in the closed position to prevent the upward travel of warm air from the building and to prevent the downward travel of cold, outside air.

Prior damper systems have included an elongated lever, operatively attached to one or more of the plate members, and extending downwardly from the damper into the fireplace. By pivotally moving the lever, the operator opens and closes the damper plates, as desired. However, although they have been used for many years, such dampers have several undesirable features. It is aesthetically displeasing for the lever to hang down into the fireplace where it is easily seen. Consequently, the damper levers are short and terminate at a level above the area viewable by the casual observer. Such a termination level has several effects, the first being that the operator has to enter the fireplace to locate the lever and then reach in with a hand or poker to move it. Having to look upwardly toward the damper creates the possibility of having debris fall in the operator's face particularly if the lever or the damper plates are jostled. Also, the fireplace is frequently quite hot just after use, making it uncomfortable for the operator to enter the firebox. Moreover, because the damper lever is "out of sight-out of mind," many operators have failed to open the damper prior to lighting a fire in the fireplace. The natural result of such failure is that a rather substantial amount of smoke and hot combustion gases pour out of the fireplace into the room. In the hot, smoky environment which is created, it is exceedingly difficult to locate and adjust a damper lever within the fireplace, even with a poker. Instead, the fire must be doused and started again with dry material.

The prior lever-operated dampers have been improved to a degree by providing means for operating the damper from outside the fireplace. Specifically, in some damper systems, the pivotal lever has been replaced with a longitudinally movable rod, one end of which is operatively connected to the damper plates to pivot the plates between an open position and closed position. The opposing end of the rod is operatively connected to a handle, which is rotatably mounted in the lintel of the fireplace front opening, i.e., immediately above the front opening of the fireplace. Rotation of the handle in one direction causes the rod to move longitudinally in one direction, opening the damper plates, and rotation in the opposing direction causes the rod to close the damper plates. The location of the handle in the lintel has been considered necessary in order to avoid creating an opening in the upper portion of the fireplace through which smoke and gases escape.

Disregarding the unaesthetic effect of a handle extending from the middle of a fireplace lintel, such damper systems have not proven satisfactory for the fireplaces which include a glass screen over the front opening. Glass screens have proven very effective at limiting the heat losses incurred by open fireplaces. However, such screens frequently cover the lintel in order to achieve a good seal. Thus, if the screen extends above the damper handle, the screen must be opened in order to reach the handle to close the damper. In some cases, however, the lintel location makes it impossible to add a ready-made glass screen because of direct interference therebetween.

It is therefore an object of the present invention to provide a damper system which is operable from a location outside the fireplace with or without a fireplace screen. It is also an object to provide a damper system which does not require piercing the fireplace at a level above the lintel. It is a further object to provide a damper system which is adaptable for varying thicknesses of wall adjacent to a fireplace. Further objects and advantages will be apparent from the following description is read in connection with the drawings in which.

Figure 2:
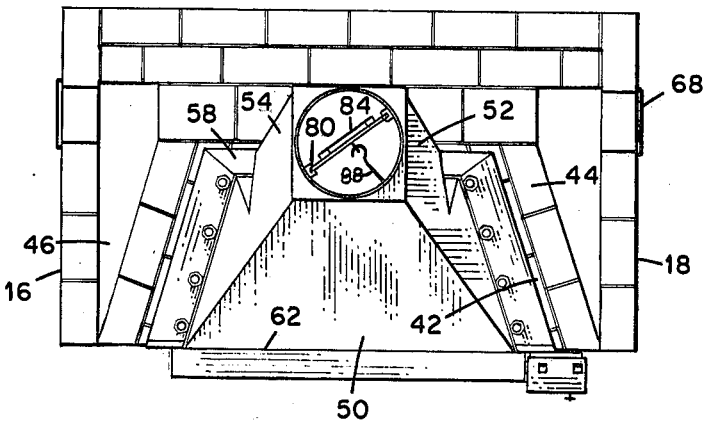
FIG. 2 is a top plan view of the fireplace shown in FIG. 1.
Figure 1:
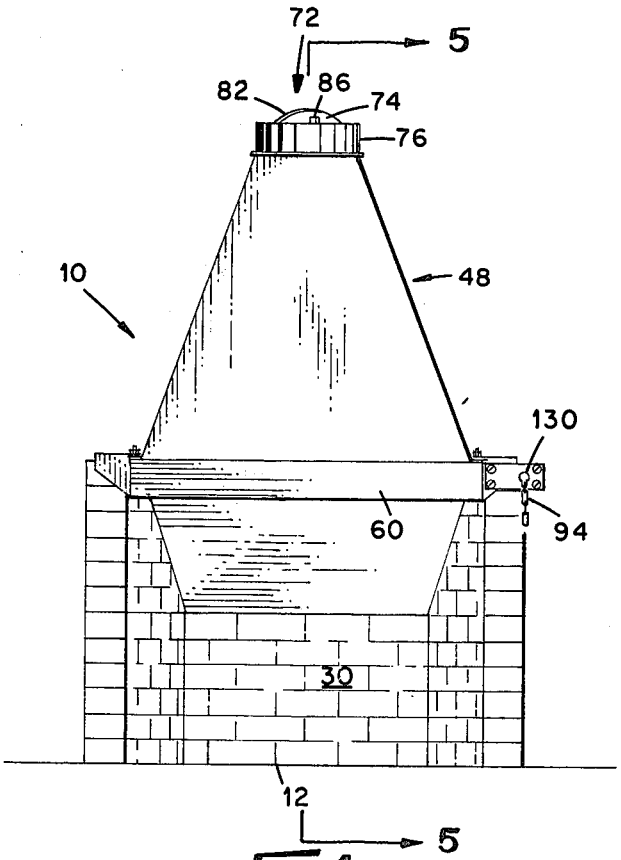
FIG. 1 is a front elevational view of a fireplace including a damper system embodying various of the features of the present invention.
Figure 3:
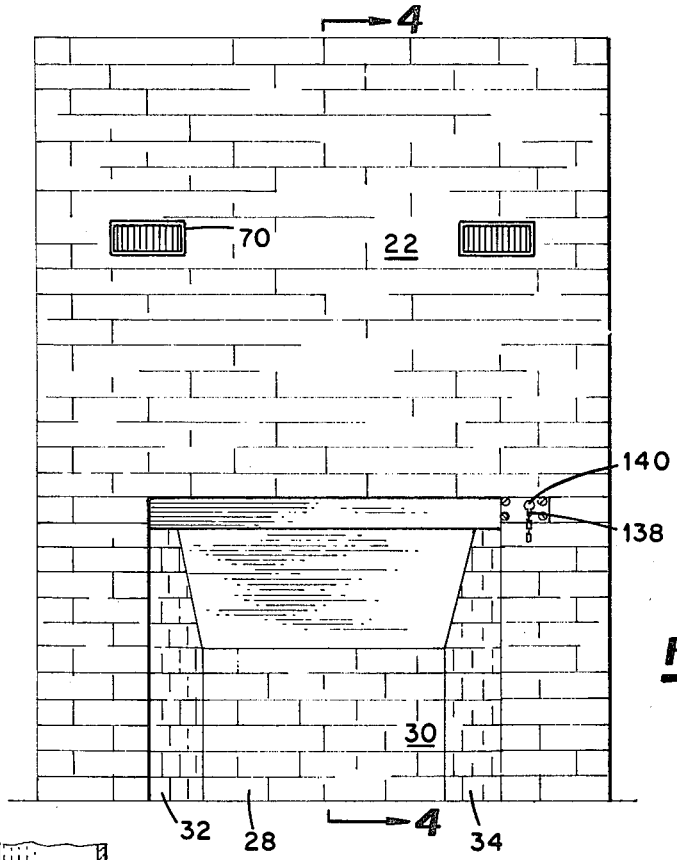
FIG. 3 is a front elevational view of the fireplace shown in FIG. 1 after the addition of a face wall.

Generally, a damper system in accordance with the present invention is adapted for use in connection with a fireplace which includes a front opening providing communication between the fireplace and a room of a building and an upper opening providing communication with the atmosphere through a chimney. The damper system includes plate means pivotally mounted within a sleeve member extending downwardly from the upper opening. Elongated flexible means are connected to the plate means and extend therefrom to a location within the room and spaced away from the front opening of the fireplace such that the plate means is selectively pivotable by an operator without penetrating the front opening.

Referring to the drawings, in one embodiment a fireplace 10 is defined by a floor 12, a top wall 14, a pair of opposed vertical parallel side walls 16 and 18, a vertical rear wall 20 and a vertical front wall 22, parallel to the rear wall 20. A front opening 24 is defined in the front wall 22, extending between the side walls 16 and 18 to provide communication between the fireplace and the room 26. An upper opening 27 is defined in the top wall 14 to provide flow communication between the fireplace 10 and a chimney 29.

A firebox 28 is defined in the fireplace 10 by an interior rear wall 30 and opposing interior side walls 32 and 34, each of which extends approximately one-half the distance from the floor 12 to the top wall 14, terminating at a ledge 36. The interior rear wall 30 comprises an inner layer 38 of fire bricks and an outer layer 40 of insulating concrete blocks. Each of the interior side walls 32 and 34 comprises an inner layer 42 of fire bricks and an outer layer 44 of conventional bricks. The interior side walls 32 and 34 are not parallel to one another, but rather approach one another from the front wall 22 to the interior rear wall 38. As a result of the spaced relationship between the side walls 16 and 18 and the interior side walls 32 and 34, respectively, a chamber 46 is defined along each side of the firebox 28 to permit air flow alongside the box.

A heater sleeve 48, including a front wall 50 and a rear wall 51 interconnected by a pair of opposed side walls 52 and 54, extends from the firebox 28 to the upper opening 27. The sleeve 48 is supported on the ledge 36 of the firebox walls 30, 32 and 34 by a flange 58 which extends laterally from the walls 51, 52 and 54 of the sleeve 48. A rectangular tubular member 60 extends laterally from the forward sleeve wall 50 along the lower edge 62. The member 60 is located immediately below the lintel 61 which supports the portion of the front wall 22 above the front opening 24. An extension plate 64 attached to the rear wall 51 of the heater sleeve 48, extends downwardly and rearwardly into the firebox 28. The plate 64 is oriented at an angle with the rear interior wall 30 to reflect heat outwardly through the front opening 24. At the upper opening 27, the heater sleeve 48 matingly engages a vent pipe 56 located within the chimney 29. The heater sleeve 48 is spaced from the walls 16, 18, 20 and 22 to define a concentric chamber 66 which interconnects the chambers 46 along side the firebox 28. The sleeve 48 comprises a sheet metal material adapted to absorb heat from combustion gases passing therethrough, from the firebox 28 to the chimney 29. The metal sleeve 48 in turn transmits heat to the air contained in the chamber 66.

A grill 68 is located in the lower portion of each of the side walls 16 and 18 to provide flow communication between the chambers 46 and the room 26. A pair of grills 70 are located in the upper portion of the front wall 22 to provide flow communication between the chamber 66 and the room 26. Thus, when a fire is burning in the firebox 28, the air in the chambers 46 and 66 is heated, and the warm air rises naturally through the chambers 46 and 66 to exit through the grills 70. Simultaneously cooler air is drawn from the room 26 through the grills 68 for further heating and exit into the room 26.

A damper plate 72 is pivotally mounted within the sleeve 48 at the upper opening 27. The damper plate 72 comprises a disc 74 having a shape and size substantially equivalent to the cross-sectional area of the mating section 76 of the sleeve 48. A pair of cylindrical pivot members 78, each of which includes a diametrical slot 80, adapted to receive the edge 82 of the disc, are attached to the disc 74. The cylindrical pivot members 78 are arranged coaxially, being located diametrically opposite to one another. Each of the members 78 is seated in the section 76. The axis of the members 78 defines the pivotal axis of the damper plate 72. A weight member 84 is attached to the disc 74 on one side of the pivotal axis, thus biasing the disc 74 to a vertical, or open, position. In the depicted embodiment the pivotal axis is horizontal and forms an angle of about 35° with the front wall 22. A bracket 86 is attached to the disc 74 at a location opposite from the weight member 84. A first end 88 of an elongated rod member 90 having a first end 88 and a second end 92 is pivotally attached to the bracket 86. The end 88 is bent into a hook pattern for engaging the bracket 86. The rod 90 extends downwardly, forwardly and laterally from the damper plate 72. Thus, the rod 90 is parallel to, and adjacent to, the intersection of the side wall 52 and front wall 50 of the sleeve 48. The rod 90 terminates at the second end 92 located above the firebox 28. The second end 92 of the rod 90 is also bent into a hook pattern. A flexible chain 94 is attached to the hooked second end 92 and extends therefrom along a non-linear path into the room 26.

A pulley member 96 is rotatably mounted upon a bracket 98 secured to the interior wall 100 of the member 60 adjacent to the intersection of the member 60 and the interior side wall 34. The axis of rotation of the pulley member 96 is arranged parallel to the pivotal axis of the damper plate 72.

A slot 102 is defined in the interior wall of the tubular member 60 adjacent to the interior side wall 34. The slot 102 is located at the same height as the lowermost edge of the pulley member 96.

Figure 7:
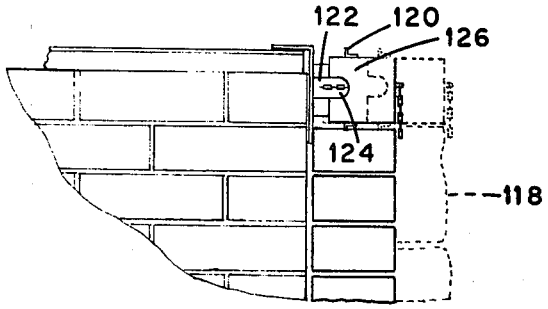
FIG. 7 is a cross-sectional view taken along line 7—7 of FIG. 6.

A telescoping box 104, including an interior base member 106 and an exterior cover member 108 is mounted in the front wall 22 at the forward edge 110 of the interior side wall 34 adjacent to the member 60. The base member 106 is attached to an extension tab 112 of the member 60 by means of bolts 114. A pulley member 116 having a vertical axis of rotation is rotatably mounted within the member 106 at the same height as the lowermost edge of the pulley member 96. The cover member 108 is telescopically mounted upon the base member 106 such that the cover member 108 is extendible relative to the member 106 and thus adjustable for varying thicknesses of the front wall 22. This feature is particularly useful where a stone facade 118 is added to the exterior surface of the front wall 22, as shown in dotted outline in FIG. 7. A plurality of masonry anchors 120 extend from the cover 108 for securing the cover 108 in the desired position with mortar.

Horizontal slots 122 and 124 are defined in the side walls 126 and 128, respectively, of the base 106 and cover 108, respectively, and a key-hole slot 130 is defined in the front wall 132 of the cover 108, all slots being located in a common plane with the pulley member 116 and the slot 102 in member lintel 60. Thus, a non-linear passageway 133, between the slot 102 and the key-hole slot 130 is defined by the tubular member 60 and the box 104. The length of the passageway 133 is adjustable in accordance with the thickness of the front wall 22 by telescopic extension of the box 104.

The flexible elongated chain 94 is connected at a first end 134 to the hooked end 92 of the rod 90. The chain 94 extends from the rod 90, continuing essentially colinearly with the rod 90 to engage the pulley member 96. The chain 94 wraps partially around the pulley member 96 such that the chain 94 is directed horizontally from the pulley member 96 toward the pulley member 116 for engagement therewith. The slots 102, 122, and 124 are sized and arranged such that the direct path between the pulleys 96 and 116 passes through the slots 102, 122 and 124. The chain 94 wraps partially around the member 116 such that the chain is directed horizontally, perpendicular to the front wall 22. The chain 94 then extends through the key-hole slot 130 in the cover member 108 for selective engagement therewith.

Figure 4:
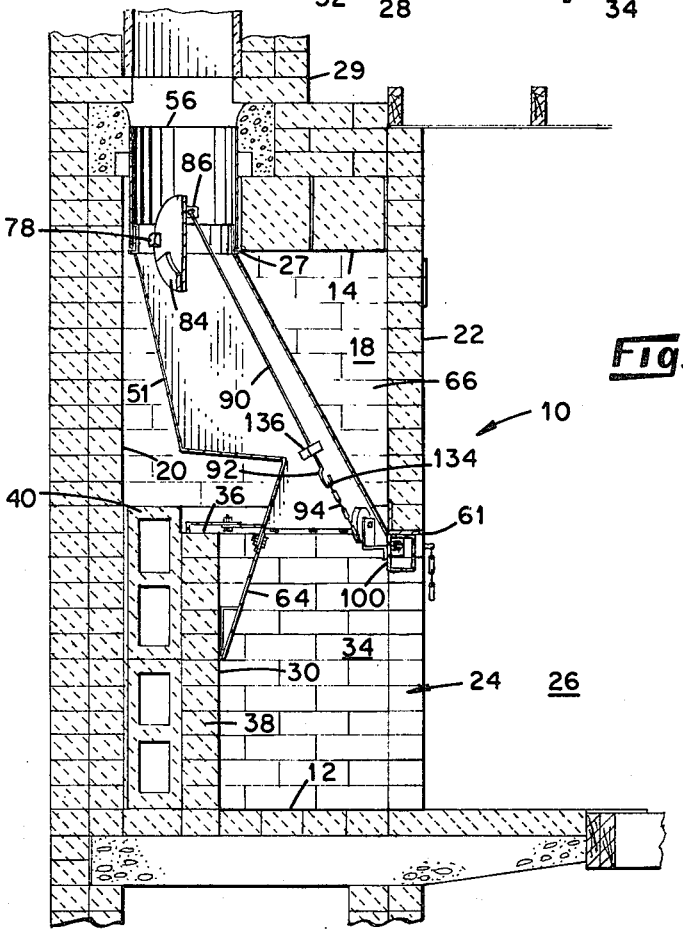
FIG. 4 is a cross-sectional view of the fireplace shown in FIG. 3, taken along line 4—4.
Figure 5:
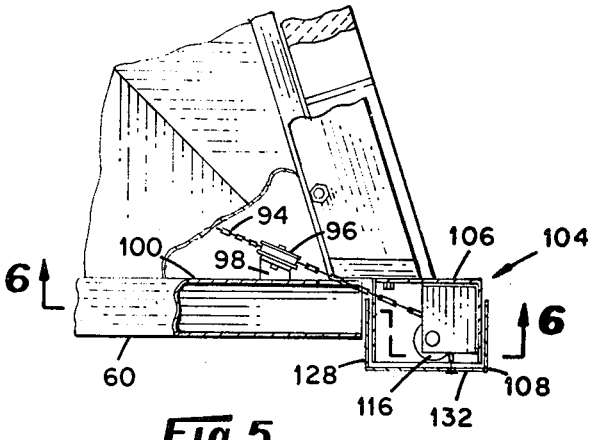
FIG. 5 is a partially broken away, cross-sectional view of the fireplace of FIG. 1, taken along line 5—5.
Figure 6:
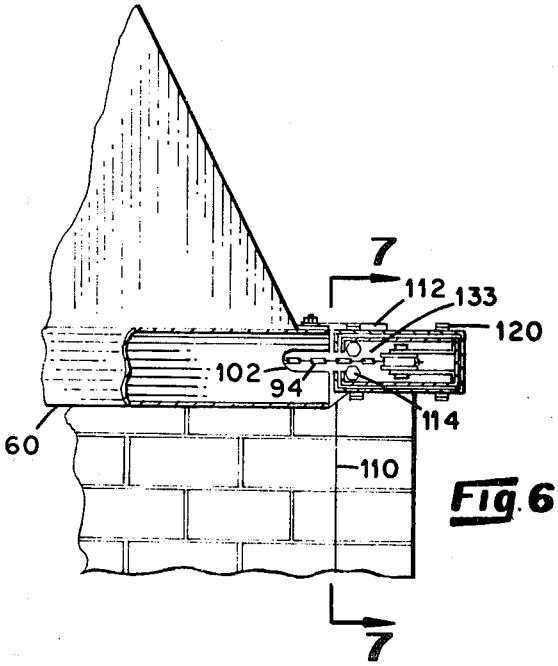
FIG. 6 is a partially broken away, cross-sectional view taken along line 6—6 of FIG. 5.

As shown in the embodiment depicted in FIG. 4, a loop member 136 is attached to the side wall 52 of the sleeve member 48. The rod 90 passes freely longitudinally through the loop member 136, yet the rod 90 is prevented from swaying and drawing the chain 94 into the fireplace 10.

As noted above, the damper plate 72 is normally biased to an open position by the weight member 84. Thus, to open the damper plate 72, the operator merely lifts the chain 94 from the narrow, engaging portion 138 of the slot 130 and permits the natural pivotal motion of the damper plate 72, caused by gravity's effect upon the weight member 84, to longitudinally draw the rod 90 upwardly. The rod 90 in turn draws the chain 94 through the passageway 133. The operator then drops the chain back into the engaging portion 138 of the slot 130 to secure the chain 94.

Thereafter, when the operator chooses to close the damper, he merely lifts the chain 94 from the engaging portion 138 into the circular portion 140 and pulls it outwardly therethrough. The movement of the chain 94 outwardly through the slot 130 is converted by the pulleys 96 and 116 into longitudinal tension upon the rod 90, which in turn pulls downwardly upon the bracket 86, closing the damper plate 72. When the damper plate 72 reaches the horizontal, or closed position, the operator again drops the chain into the portion 138 of the slot 130 for secure engagement therewith.

A damper system in accordance with the present invention permits the operator to open and close the damper without entering the firebox, either manually or with a poker. Moreover, there is no handle which prevents a fireplace screen from being mounted over the front opening, nor must such a screen be opened in order to open or close the damper. Furthermore, with the exception of the upper opening to the chimney, there is no opening above the lintel through which smoke and combustion gases can escape.

While a preferred embodiment has been shown and described herein, it will be understood that there is no intention to limit the invention by such disclosure but rather it is intended to cover such modifications and alternate constructions falling within the spirit and scope of the invention as defined in the appended claims.

What is claimed is:

1. A damper system in combination with a fireplace including a firebox having a front opening in communication with a room, a lintel, a corner passageway offset from said front opening in communication with said firebox, and below said lintel, an upper opening spaced above said front opening, and a sleeve member extending downwardly from said upper opening toward said front opening to direct combustible product from said fireplace to said upper opening, said damper system comprising weighted plate means pivotally mounted within said sleeve member and biased to an open position, support means connected to said plate means and extending from said plate means through said support means and into said room, means for guiding said elongated flexible means for passage through said corner passageway and through said support means, locking means for selectively securing said flexible means within said support means, whereby said plate means is selectively pivotable by an operator through said flexible means without penetrating said front opening.

2. A damper system, as defined in claim 1, wherein said elongated flexible means comprises a rod member pivotally attached to said plate means and a chain member attached to said rod member.

3. A damper system as defined in claim 1 wherein said passageway includes a telescoping box whereby the length of said passageway is selectively adjustable.

* * * * *